United States Patent [19]

Seymour

[11] Patent Number: 4,732,384

[45] Date of Patent: Mar. 22, 1988

[54] RACQUET HAVING CENTRALIZED SWEET SPOT

[76] Inventor: Robert J. Seymour, 27, Meadow Walk, Ewell Village, Surrey, England

[21] Appl. No.: 635,589

[22] Filed: Jul. 27, 1984

[30] Foreign Application Priority Data

Jul. 28, 1983 [GB] United Kingdom ..... 8320407
Oct. 13, 1983 [GB] United Kingdom ..... 8327461
Oct. 27, 1983 [GB] United Kingdom ..... 8328689

[51] Int. Cl.[4] ..... A63B 49/02

[52] U.S. Cl. ..... 273/73 C; 273/73 D; 273/73 G; 273/73 J; 273/73 H

[58] Field of Search ..... 273/73 C, 73 D, 73 R, 273/73 G, 73 F, 73 J, 73 H, 73 K

[56] References Cited

U.S. PATENT DOCUMENTS

| | | | |
|---|---|---|---|
| 1,539,019 | 5/1925 | Nikonow | 273/73 R |
| 2,164,631 | 7/1939 | Abell | 273/73 H |
| 3,528,658 | 9/1970 | Cheris et al. | 273/73 C |
| 3,547,440 | 12/1970 | Deer | 273/73 J |
| 3,582,072 | 6/1971 | Stueck | 273/73 J |
| 3,834,699 | 9/1974 | Pass | 273/73 C X |
| 3,999,756 | 12/1976 | Head | 273/73 C |
| 4,478,416 | 10/1984 | Gibello | 273/73 C |

FOREIGN PATENT DOCUMENTS

| | | | |
|---|---|---|---|
| 2450114 | 10/1980 | France | 273/73 C |
| 427206 | 4/1935 | United Kingdom | 273/73 D |
| 755257 | 8/1956 | United Kingdom | 273/73 C |

*Primary Examiner*—Matthew L. Schneider
*Attorney, Agent, or Firm*—Berman, Aisenberg & Platt

[57] ABSTRACT

A racquet for striking a ball or other projectile in a game, having a stringed head, in which the racquet is so constructed that, for an impact in the region of the sweet-spot, each of those strings which yield do so substantially symmetrically about a plane which is perpendicular to the string and which passes through the center of impact. The racquet includes a diagonally strung hitting surface and an open throat design defined by a bridge portion whose linear density is equal to the linear density of the rest of the frame. In addition, the racquet half located closest to the grip weighs substantially the same as the racquet half located farthest from the grip. The resulting structure of the racquet serves to centralize the sweet spot of the racquet at the geometric center of the circular head portion.

1 Claim, 11 Drawing Figures

RACQUET HAVING CENTRALIZED SWEET SPOT

BACKGROUND OF THE INVENTION

The present invention relates to a racquet.

The "sweet-spot" of a racquet is that region of the head of the racquet for which impact by a ball during play imparts little or no reaction at the hand grip of the racquet, so that the player experiences little or no jarring or kicking action of the hand grip in his hand as the stroke is played.

The "sweet-spot" of a racquet may alternatively be defined as that region of the head of the racquet for which the coefficient of restitution, being the quotient of (a) the velocity of the ball relative to the racquet on rebound divided by (b) the relative approach velocity, is at its greatest, or nearly so, during play.

Hitherto, the head of a tennis racquet, for example, has been made with an oval or egg-shape, the major axis of this shape coinciding with the centre-line of the shaft of the racquet. The strings of the head extend parallel with and perpendicular to the major axis. Furthermore the sweet spot, being that area of the head of the racquet which is most effective in striking the ball, is off-centre in relation to the head. Although the sweet spot lies on the major axis, it is below the centre of the racquet head, being spaced therefrom in a direction towards the hand grip. This means that only a relatively small proportion of the racquet head is useful in striking the ball. Also, there is an asymmetry in the amount of error allowed for in different directions from the centre of the sweet spot. Thus the accuracy with which the ball must be struck in terms of the distance of the centre of impact or the centre of percussion from the centre of the sweet spot in a direction towards the hand grip is much greater than it is in relation to the distance of the centre of percussion from the centre of the sweet spot in a direction away from the hand grip. Also, there is an asymmetry in the manner in which the strings yield an impact even at the centre of the sweet spot.

SUMMARY OF THE INVENTION

The present invention seeks to reduce the extent to which a racquet is subject to the foregoing disadvantages.

Accordingly the present invention, is directed to a racquet for striking a ball or other projectile in a game, having a stringed head with a first set of strings and a second set of strings which extend transversely of the first set, in which the longitudinal centre line of each set substantially bisects each and every string of the other set, in which both sets have substantially a mirror symmetry, as defined herein, about their longitudinal centre lines, in which for each and every string of one set there is a string of substantially equal length, as defined herein, in the other set, and in which the centre lines of the two sets intersect centrally, as defined herein, in relation to the sweet-spot of the racquet.

Such a racquet provides a unique advantage over conventional racquets in that when the ball is struck by the racquet at the sweet-spot thereof, a maximum amount of contact between the ball and the strings can be achieved. This is advantageous because greater control on the ball or other projectile can be achieved the greater is the amount of contact between the ball or other projectile and the strings.

Thus an advantage of such a racquet is that, at least for impact at the centre of the sweet-spot with uniform tensioning of the strings, a maximum amount of contact between the ball or other projectile and the strings can be achieved. This is an improvement over a conventional racquet, in which the tension in the main strings, which are longer than the cross strings, is not increased as much as it is in the cross strings for a given depth of penetration by the ball, beyond the usual plane of the strings, on impact. As a result, the main strings have less grip on the ball than the cross strings, and the overall contact between the ball and the strings is less than it would be were the cross strings generally of the same length as the main strings.

Further improvement is obtainable where the strings of each set are shorter the further they are from the longitudinal centre line of the set, such as is obtained with a geometrically circular stringed head. This allows for the fact that, for a ball striking the centre of the sweet spot, the strings yield less the further they are from the centre of percussion, owing to the curvature of the ball.

In view of the greater string contact with a racquet in accordance with the present invention, lower tensioning of the strings is possible to provide the same power of stroke, thus giving longer life to the racquet strings and greater ball control. Alternatively, for the same tensioning, greater power of stroke can be obtained for a given degree of ball control.

A further shortcoming in the foregoing conventional design of a tennis racquet is the relative angle of the strings in relation to the ball when the latter is struck by the racquet in the most common manner, that is to say with the racquet extending upwardly fro the hand of the player at an angle of about 45 degrees. With such a stroke, if, for example, it is desired to put a top spin on the ball, the strings all tend to be at an angle of about 45 degrees in relation to the direction of the stroke. This impairs the extent to which the strings impart top spin.

To reduce the extent to which a racquet is subject to this further disadvantage, in a preferred form of the invention the strings of the racquet all extend at substantially 45 degrees to the shaft centre-line.

With such a racquet, energy loss from ball slip and also string movement are reduced.

A racquet with a geometrically circular stringed head provides a mirror symmetry in the manner in which the strings yield on impact at or substantially at the geometrical centre of the racquet head. At the same time, a racquet made as an example of the present invention has a weight distribution which is such as to place the sweet-spot at or substantially at the geometrical centre of the racquet head. For example the use of a bridging portion, where the head meets the racquet shaft, which is of the same cross-section and linear density as the rest of the frame, so that that half of the racquet head frame which is furthest from the hand grip is of the same weight as that half of the racquet head frame which is nearer to the hand grip, assists in providing a sweet-spot which is at or substantially at the geometrical centre of the racquet head. The use of an open throat where the head meets the shaft also assists in this respect.

Thus, a symmetry in the manner in which the strings yield on impact is obtained in the region of the sweet-spot.

From the point of view of obtaining such a symmetry in the manner in which the strings yield on impact, a desirable feature is that the four outermost strings of the two sets define a four-sided figure or square the corners of which are at the inside surface of the racquet head frame. Also arranging the strings obliquely to the shaft axis of te racquet is believed to widen the sweet spot transversely of the racquet.

Preferably, the strings are all tensioned to substantially the same degree, and have substantially the same resilience. Alternatively, the tensioning and/or resilience of the strings is substantially symmetrical about the centre of the sweet spot.

BRIEF DESCRIPTION OF THE DRAWINGS

Examples of a tennis racquet made in accordance with the present invention are illustrated in the accompanying drawings in which.

DESCRIPTION OF THE PREFERRED EMBODIMENTS

Figure 1:
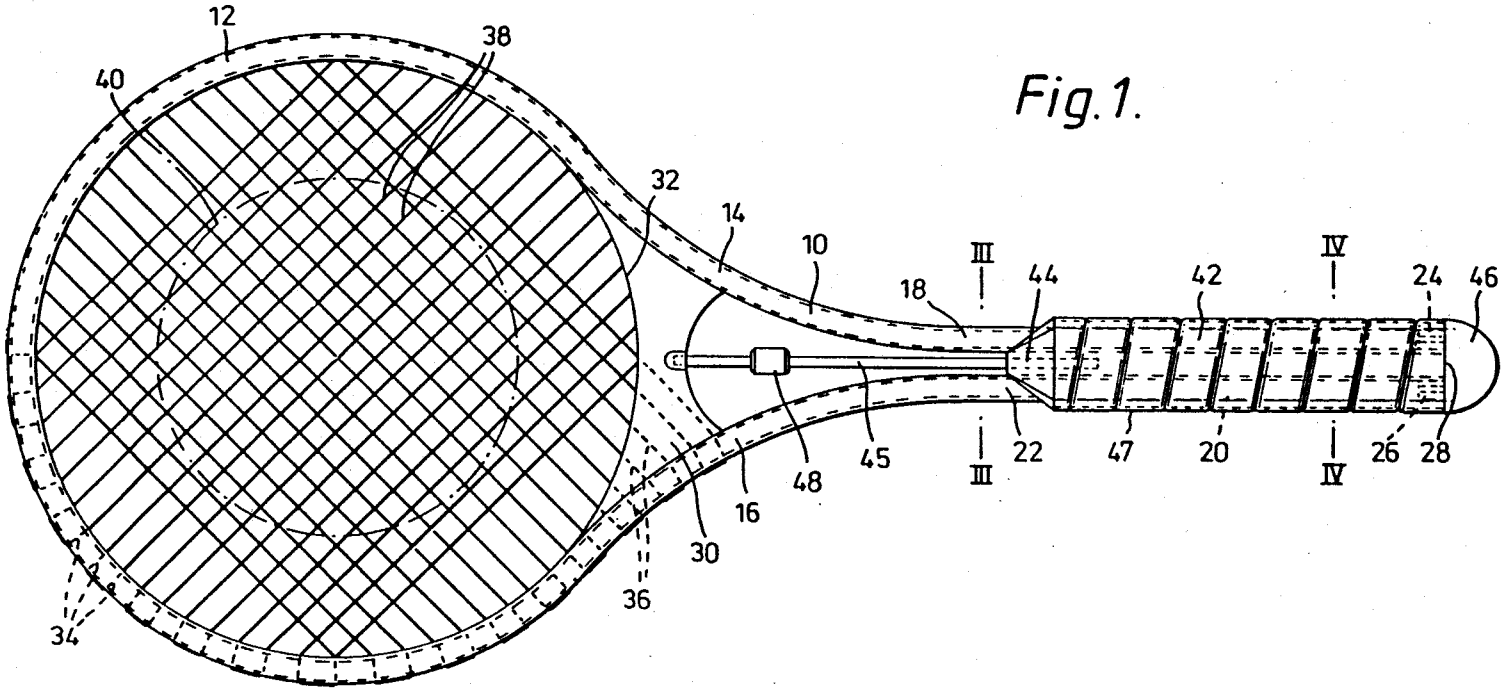
FIG. 1 shows a plan view of a first example.
Figure 2:
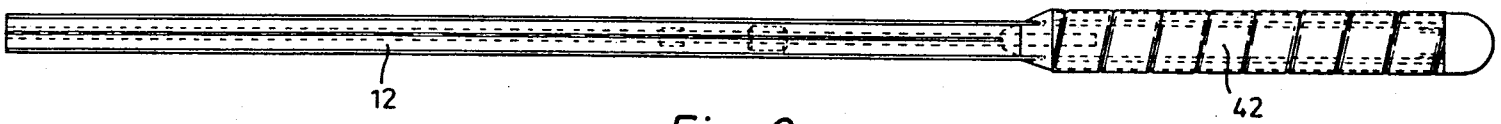
FIG. 2 shows a side view of the racquet shown in FIG. 1.

The tennis racquet shown in FIG. 1 comprises an aluminium extrusion 10 which has been bent around a former to define a circular frame 12 for the head of the racquet, two concave mutually converging curved portions 14 and 16 extending from the circular frame 12, and two straight parallel adjacent portions 18 and 20 continuing from the curved portions 14 and 16 to define a shaft 22 of the racquet, the two ends 24 and 26 of the extrusion 10 being adjacent to one another at a base 28 of the racquet.

A plastics moulding bridging piece 30 is bonded between the two inwardly curved portions 14 and 16 of the extrusion 10. The edge 32 of this bridging piece 30 which faces the head of the racquet is arcuate and concave. The frame 12 and the bridging piece 30 thereby together define a substantially geometrically circular head of the racquet. Thus the radius of curvature of the edge 32 is the same as that of the inside of the extrusion 10 where it defines the head frame 12, the edge 32 being a continuation of the circle defined by the inside of that frame.

Grommets 34 extend radially through the extrusion, centrally in relation to its thickness. These grommets are spaced apart around the frame 12. Bores 36 extend diagonally through the bridging piece 30 in registration with associated grommets 34 in the inwardly curved portions 14 and 16 of the extrusion 10. By means of the grommets in the extrusion 10, and the holes in the bridging piece 30, nylon or gut strings 38 are threaded onto the frame 12 in such a manner as to provide first and second sets of mutually parallel strings all extending at substantially 45 degrees to the shaft centre-line, with the first set of strings being perpendicular to the second set. The racquet has a sweet spot, shown diagrammatically at 40, the centre of which coincides with the geometrical centre line of the frame 12. The grommets 34 may be so spaced around the frame 12 that the strings of each set are spaced apart uniformly, or alternatively with a greater density of strings in the central area of the racquet head.

A rubber hand grip 42 is heat bonded to the straight portions 18 and 22 of the extrusion 10. A two-part frusto-conical plastics moulded end cap 44 is positioned at the top end of the hand grip 42, and a substantially hemispherical plastics moulded end cap 46 is attached to the base end 28 of the hand grip 42. The latter is provided with a leather wrapper 47 in the conventional manner.

A tubular aluminium rod 45 has one end bonded in a centrally positioned socket moulded in the bridging piece 30 and its other end firmly bonded in the upper end of the hand grip 42. It is thus held along the shaft centre-line. An adjustable balance weight 48 is held on this rod 45 at a position lying on or close to the centre of gravity of the whole racquet. The adjustable balance weight 48 comprises two halves which may be screwed together to effect a friction grip on the rod 45. Adjustment of the weight 48 up or down the rod 48 effects a bias away from or towards the hand grip 42.

Figure 3:
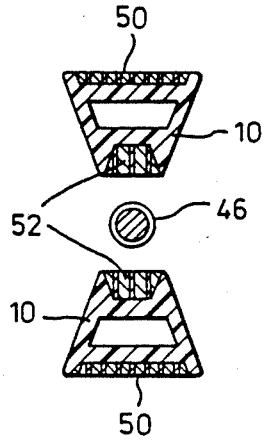
FIG. 3 shows, on a larger scale, a cross-section through a shaft of the racquet.
Figure 4:
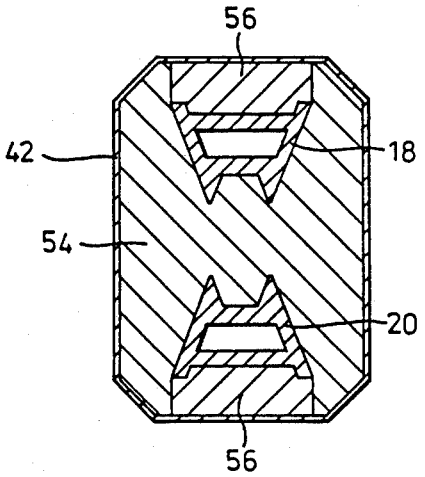
FIG. 4 shows, on a larger scale, a cross-section through a hand grip of the racquet.

Further details of the extrusion 10 and hand grip 42 are evident from FIGS. 3 and 4 respectively. Thus, from FIG. 3 it can be seen that the cross-section of the extrusion 10 is of truncated triangular shape to give the racquet greater rigidity. The truncation is on the inwardly facing side of the extrusion. It can also be seen that the extrusion is tubular, being hollow, and has channels formed along its inside and outside surfaces for respective plastics polypropolene moulding covers 50 and 52.

From FIG. 4 it can be seen that the hand grip 42 comprises a main rubber extrusion 54 which is roughly H-shaped in cross-section and has ribs extending along both sides of the cross-piece of the H which are received in the inwardly-facing channels of the straight portions 18 and 20 of the extrusion 10. Further rubber inserts 56 and 58 cover the outsides of those portions of the extrusion 10 to complete the hand grip 42, so that the extrusion 10 is entirely embedded in the hand grip.

The dimensions of the cross-section of the hand grip 42 are such that the depth of the grip, being the dimension of the hand grip in a direction perpendicular to the plane of the head of the racquet, is substantially two-thirds the width of the hand grip, being the dimension thereof in a direction lying in the plane of the head and transverse to the shaft. This gives a particularly ergonomic ratio of the depth of the grip to its width corresponding to the hollow of a players grip. With these dimensions, it is also easier to restrain twisting of the hand grip within the hand.

The combination of the shaft structure, with the particular aluminium extrusion used, to provide rigidity to the racquet, together with the rubber handle which completely encloses the shaft, reduces the transmission of vibration from the racquet head to the players arm, thus reducing the likelihood of the player suffering from tennis elbow.

The only differences between the tennis racquet shown in FIGS. 5 and 6 and the racquet shown in FIGS. 1 to 4, are as follows:

(a) the frame 12, instead of comprising an aluminium extrusion, comprises resin impregnated carbon fibre with a laminated balsa wood core (described hereinafter in greater detail with reference to FIG. 6);

(b) the rod 45 and balance weight 48 shown in FIG. 1 have been omitted to give a simpler and therefore less expensive construction of racquet;

(c) a bridging piece 30 of FIG. 1 has been replaced by a bridging portion 31 of the frame 12 having the same construction as the rest of the frame, this bridging portion also being used for stringing the racquet head.

Figure 5:
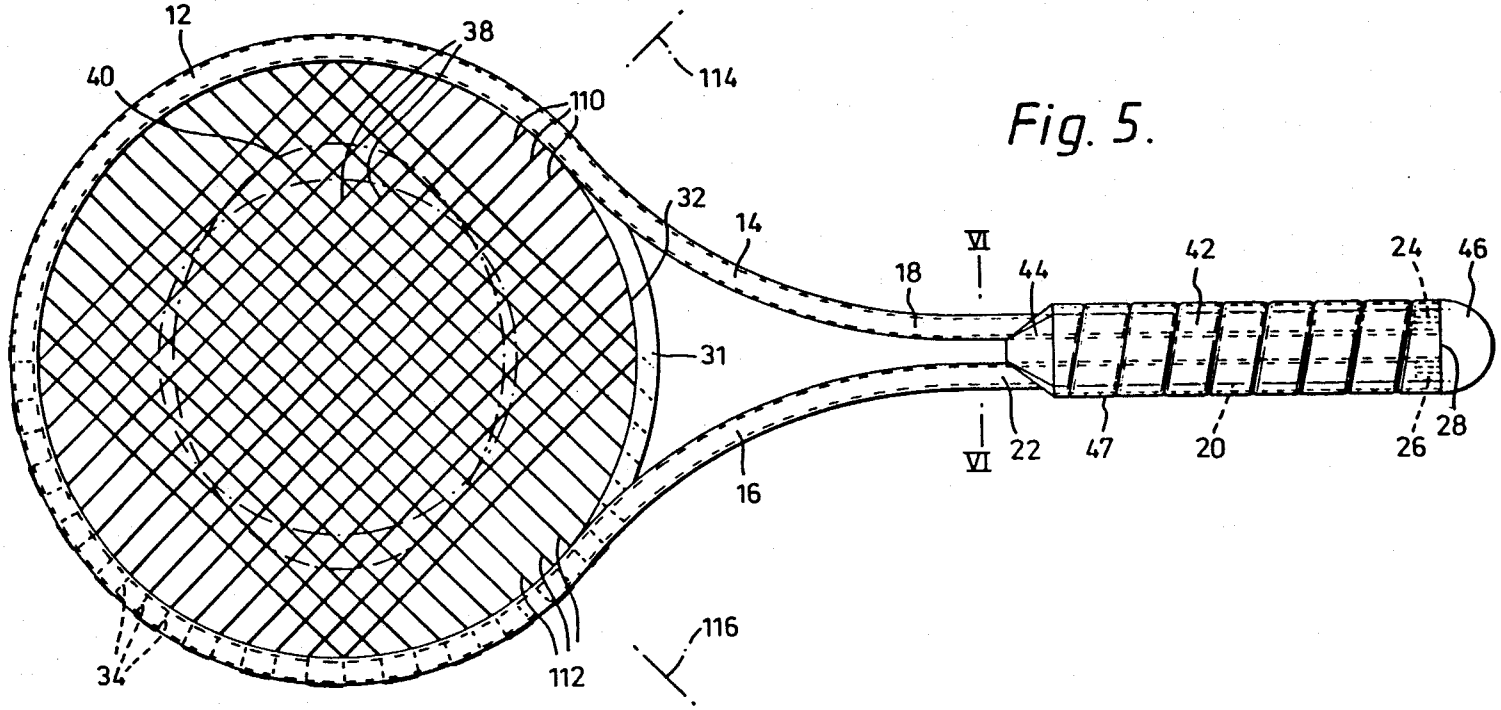
FIG. 5 shows a plan view of a second example.
Figure 6:
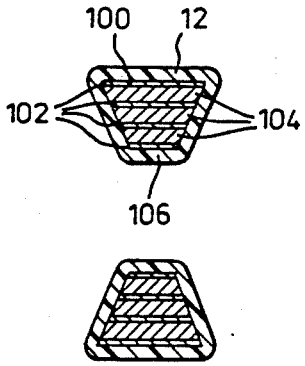
FIG. 6 shows, on a larger scale, a cross-section through a shaft of the racquet shown in FIG. 5 taken along the line VI—VI.

The racquet shown in FIGS. 5 and 6 has a centrally horizontally extending oval-shaped sweet-spot 40 which extends transversely more than it extends longitudinally, and which is generally heart-shaped without the dimple in the top. This aids about 80% of strokes played, for example, a top spin stroke, because the ball tends to move across the racquet head as the stroke is played. The sweet spot is shown diagrammatically in FIG. 5—its actual shape is shown in the left-hand side of FIG. 18.

The flexibility of the frame and the diagonal stringing give rise to the horizontally-extending oval sweet-spot 40. Thus the racquet illustrated in FIG. 5 has a substantially geometrically circular head with interwoven gut strings 38 threaded on to the frame 12 in such a manner as to provide a first set 110 of mutually parallel strings extending at substantially 45 degrees to the shaft centre-line, and a second set 112 of mutually parallel strings also extending at substantially 45 degrees to the shaft centre-line, and being substantially perpendicular to the first set of strings 110. The first set of strings 110 has a longitudinal centre line 114, and the second set a longitudinal centre line 116. It will be seen that, because of the substantially geometrically circular head of the racquet, three conditions arise:

(i) the centre line of each set of strings substantially bisects each and every string of the other set;

(ii) both sets of strings have substantially a mirror symmetry about their longitudinal centre lines; and (iii) for each and every string of one set there is a string of substantially equal length in the other set.

Expressed in a less formal manner this means that the two sets of strings of the racquet head are both symmetrical, are of substantially the same length, and cross one another centrally.

Such conditions can provide a maximum contact between a ball, for example, and the strings of the racquet when the ball is struck by the centre of the sweet-spot.

FIG. 6 shows in greater detail the internal construction of the frame 12. Thus it comprises a laminated balsa wood core 100. This is made up of alternate layers 102 of plywood (substantially 1 mm thick), and balsa wood 104. The grain of the balsa wood extends longitudinally of the frame. A braided tube of carbon fibre 106, which has been impregnated with the resin, is pulled or drawn over the core 100 as a sheath, after which the resin is cured to form a solid graphite sheath around the core. The flexibility of the laminated core combined with the inherent strength of the graphite sheath compliment one another to provide a frame which will yield on impact whilst being very strong and relatively light in addition to absorbing high frequency shock waves on miss hits (outside the sweet spot area). This reduces likelihood of tendonitis or tennis elbow.

A polyurethane foam core may be used as a cheaper alternative to a balsa wood core.

Figure 7:
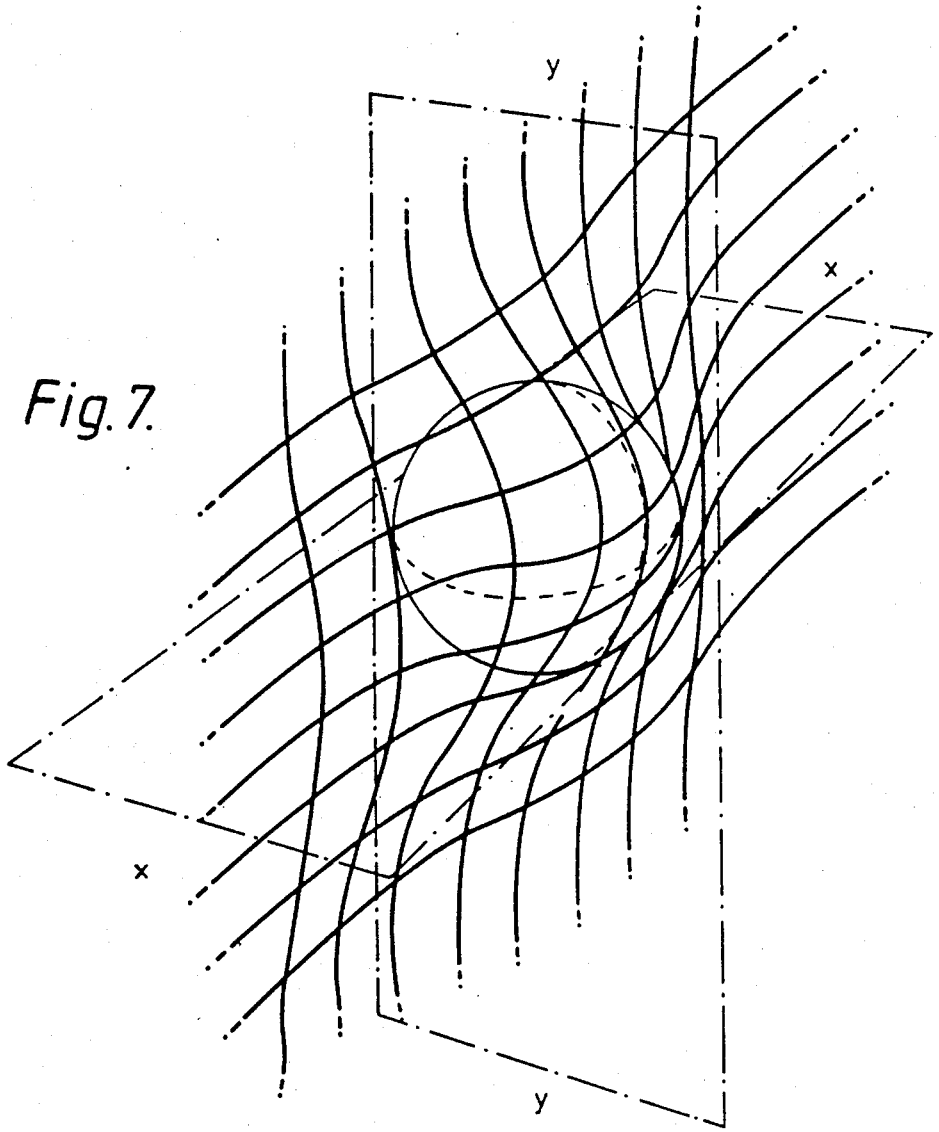
FIGS. 7 to 11 are explanatory diagrams.
Figure 8:
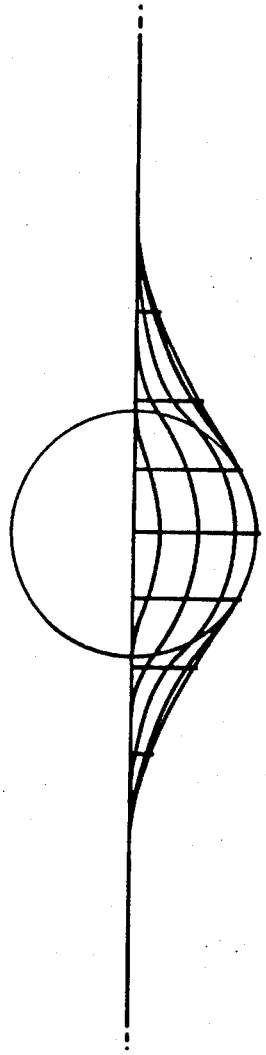

The explanatory FIGS. 7 to 10 illustrate how the racquet illustrated in FIG. 1 or FIG. 5 is advantageous over prior constructions of racquet. FIG. 7 shows how the strings yield on impact of a tennis ball at the centre of the sweet spot. FIG. 8 shows the strings looking along the plane XX towards the plane YY, these two planes intersecting at the centre of the tennis ball. The same Figure also shows the strings looking along the plane YY towards the plane XX, because of the symmetry in the manner in which the strings yield.

The symmetry is as follows: (a) each string which yields and which extends in the same direction as the XX plane is, at the instant of impact as shown, symmetrical about the YY plane; (b) each string which yields and which extends in the same direction as the YY plane is, at the instant of impact as shown, symmetrical about the XX plane; (c) the strings in which yield and which extend in the same direction as the XX plane form a symmetrical pattern about the XX plane; (d) the strings which yield and which extend in the same direction as the YY plane form a symmetrical pattern about the YY plane; (e) taking both sets of strings together, there is a rotational symmetry about the line of intersection of the XX plane and the YY plane, with the pattern of the strings being repeated four times during a full turn, after each 90 degree rotation.

This results in the maximum possible amount of string contact with the ball for a given tension in the strings and for a given strength of impulse exerted by the strings on the ball. This will be called 100% string contact.

Figure 9:
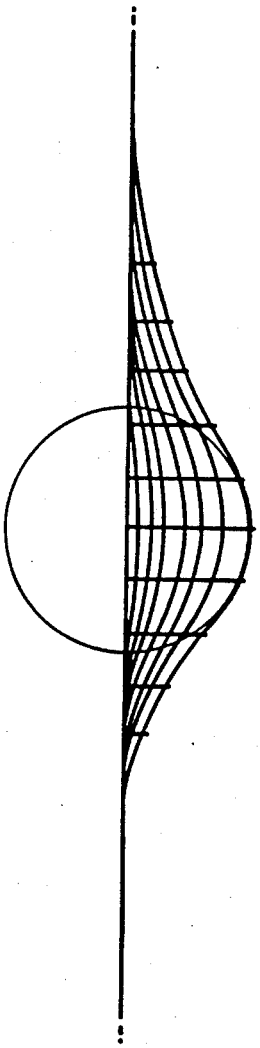

If the sweet-spot is off-centre in relation to the racquet head, as with all prior constructions of racquet, the strings yield assymetrically in the manner shown in FIG. 9. This is because the tension in the strings will be increased more on one side of the ball than on the other. As a result, with reference to that Figure, the string contact with the upper half of the ball is less than with the lower half.

Figure 10:
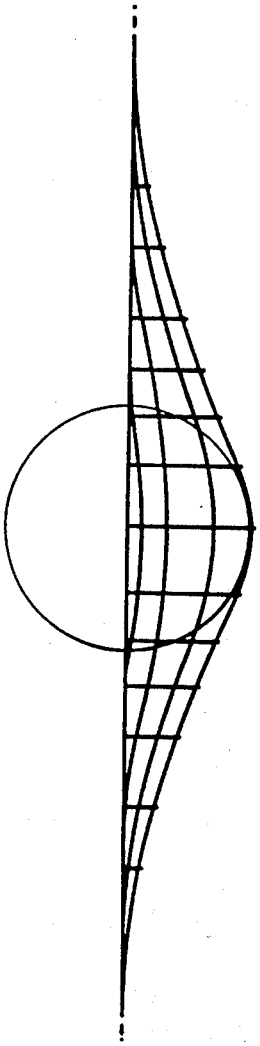

If one set of strings is longer than the other, as with all prior constructions of racquet in which the width of the head is less than the length, the increase in the tension of the cross strings for a given impact will be greater than the increase in the tension for the main strings. As a result, the main strings yield more easily than the cross strings, and any one main string has less contact with the ball than a corresponding cross string, as illustrated in FIG. 10. This assymetry means that there is less string-to-ball contact with such a conventional construction of racquet than with a racquet as shown in FIG. 1 or FIG. 5.

Figure 11:
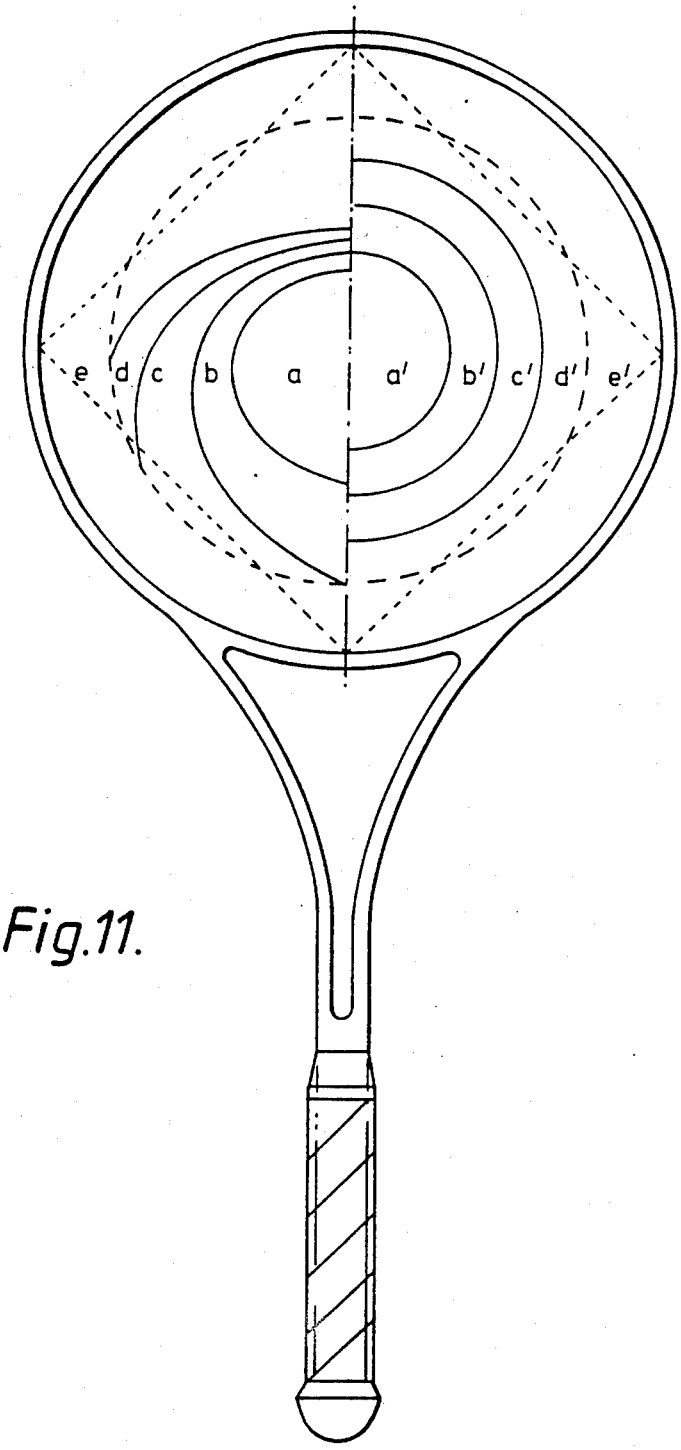

FIG. 11 shows the area a′ (which has a symmetrically identical part on the left-hand side of the racquet as viewed in that Figure) for which 100% or about 100% string contact is obtained. The area b′ affords about 80% string contact (as a percentage of the maximum obtainable), the area c′ affords 60%, and d′ 40%. e′ is an unusable area. A very good conventional racquet affords at the most 70% string contact.

FIG. 11 also shows the results of experiments on a racquet as shown in FIG. 5 or FIG. 5 held vertically. Balls were propelled towards various points on the string surface at about 60 m.p.h., and the return velocity was measured to provide a measure of the coefficient of restitution. In the region marked "a" (which includes the symmetrically identical region on the right-hand side of the racquet as viewed in that Figure), the return velocity was about 36 m.p.h., so that the coefficient of restitution was found to be about 0.6. In region b, the coefficient of restitution was about 0.5., in region c it was about 0.4, and in region d it was about 0.3. e designates an unusable area.

It will be seen from the set of curves defining the outside boundaries of these areas that the sweet spot, which could be defined as any one of these curves or an intermediate such curve, is generally heart-shaped without the dimple in the top, and is also oval so that it extends transversely more than it extends longitudinally. The "bottom" of the heart extends towards the handgrip of the racquet, so that more of the sweet spot is on the handgrip side than is on the side furthest therefrom. Because of the complexity of the shape, the "centre" of the sweet spot is not necessarily the geometric centre of the heart, but is the point towards which successively smaller curves of the set converge. In this case, the centre of the sweet spot is coincident with the geometric centre of the circular head, where 100% string contact is obtained.

The strings of any of the foregoing constructions of racquet may be bonded where they cross to reduce crimp factor.

Instead of graphite, other resin impregnated manmade fibres may be used, such as fibreglass.

Numerous other variations and modifications to the illustrated racquets will readily occur to the reader without taking them outside the scope of the present invention. One simple modification would be to use wood instead of an aluminium extrusion or graphite construction.

In this specification, where a string is stated to be substantially equal in length to another string, or one dimension is said to be substantially equal to another, benefit may be obtained where the two dimensions concerned are more or less exactly equal, or where the greater dimension is no more than 15% more than the shorter dimension, or more preferably no more than 10%, better still no more than 5%, and to be exceptionally effective no more than 3%. Substantial symmetry can be taken as more or less precise symmetry, or where measurements on one side of a plane or axis or point of symmetry differ from corresponding measurements on the other side by no more than 15%, preferably no more than 10%, better still no more than 5%, and to be exceptionally effective no more than 3%. Also, where the sweet-spot is stated to be central in relation to the racquet head, this can be taken to mean that the centre of the sweet spot is precisely central in relation to the racquet head, or off-centre by an amount which is no more than 15% of the distance between the two points which define the precise central position of the racquet head along the line of displacement, preferably no more than 10%, better still no more than 5%, and for exceptional effect no more than 3%.

A racquet as illustrated in FIG. 1 or FIG. 5 can afford the following advantages:

1. Superior ball control.
2. A sweet spot or centre of percussion placed in the geometric centre of the strung head.
3. A position and orientation of the sweet spot such as to achieve the greatest opportunity of consistent "clean" shots out of the racquet head.
4. The advantages of the greater width of the "Jumbo" racquet size incorporated within a midsize area specification, now becoming the 'standard'.
5. Maximum ball lift or top spin is obtainable and the "Magnus Effect" is increased.
6. Frame vibration on off-centre shots is reduced (significant to players who suffer from tennis elbow).
7. Twist or torque resistance of the frame is increased and possibly maximised.
8. A lightweight racquet with maximum strength and high manoeuvrability equally appealing to both male and female players.
9. The racquet appeals to fashion concious players.

The head diameters of racquets made like the ones illustrated may vary from up to 12 inches (at the maximum allowable for tennis).

I claim:

1. A racquet comprising:

(a) an elongate member having a substantially uniform linear density;

(b) a first straight portion of said elongate member at one end thereof;

(c) a first arcuate portion of said elongate member extending from said first straight portion and turning in an anticlockwise sense as the line of the member is followed in a direction away from said one end;

(d) a loop portion of said elongate member extending from said first arcuate portion, having the shape of the greater part of a geometric circle, lying in the same plane as said first arcuate portion, and turning in a clockwise sense, the curve of said arcuate portion extending substantially the whole of the distance from said first straight portion to said loop portion;

(e) a second arcuate portion of said elongate member extending from said loop portion, said second arcuate portion having the same shape as said first arcuate portion but being a lateral inversion thereof and lying symmetrically adjacent thereto;

(f) a second straight portion of said elongate member at the other end thereof extending from said second arcuate portion, and lying parallel with and adjacent to said first straight portion;

(g) a bridging portion having substantially the same linear density as said elongate member and completing the geometric circle of which said loop portion forms the greater part, to define a head of said racquet;

(h) a first set of strings of said head;

(i) a second set of strings which extend transversely of the first set, in which the longitudinal centre line of each set substantially bisects each and every string of the other set, in which both sets have a mirror symmetry about their longitudinal centre lines, in which for each and every string for one set there is a string of substantially equal length in the other set, and in which the centre lines of the two sets intersect substantially centrally in relation to the geometric centre of the racquet head;

(j) a hand grip which surrounds said two straight parallel portions of said elongate member; and (k) an open throat of said racquet defined by said first and second arcuate portions and said bridging portion;

said racquet including means for locating the sweet spot of the racquet at the geometric centre of the circular racquet head, said means comprising: a combination of said open throat, said bridge portion having substantially the same linear density as said elongate member and the weight of the racquet half located closest to said grip being substantially the same as the weight of the racquet half located farthest from said grip.

* * * * *